US005291991A

United States Patent [19]

Meyer

[11] Patent Number: 5,291,991

[45] Date of Patent: Mar. 8, 1994

[54] ELONGATE CONTAINER HAVING TWO SEPARATE COMPARTMENTS, ONE BEING AN EXTENSION OF THE OTHER

[75] Inventor: Gabriel Meyer, Vesenaz, Switzerland

[73] Assignee: Becton Dickinson France S.A., France

[21] Appl. No.: 675,904

[22] PCT Filed: Sep. 13, 1990

[86] PCT No.: PCT/CH90/00219

§ 371 Date: May 10, 1991

§ 102(e) Date: May 10, 1991

[87] PCT Pub. No.: WO91/04003

PCT Pub. Date: Apr. 4, 1991

[30] Foreign Application Priority Data

Sep. 14, 1989 [CH] Switzerland ..... 3358/89-5

[51] Int. Cl.[5] ..... B65D 81/32

[52] U.S. Cl. ..... 206/221; 206/568; 215/DIG. 8

[58] Field of Search ..... 206/216, 219-222, 206/568; 215/6, DIG. 8

[56] References Cited

U.S. PATENT DOCUMENTS

| | | | |
|---|---|---|---|
| 2,549,417 | 4/1951 | Brown . | |
| 2,807,384 | 9/1957 | Lipari | 206/221 |
| 2,813,649 | 11/1957 | Lipari | 206/221 |
| 2,869,745 | 1/1959 | Lockhart | 206/221 |
| 3,198,194 | 8/1965 | Wilburn | 206/221 |
| 3,206,080 | 9/1965 | Scislowicz . | |
| 3,464,414 | 9/1969 | Sponnoble | 206/219 |
| 4,031,892 | 6/1977 | Hurschman | 206/219 |
| 4,102,451 | 7/1978 | Clarke et al. | 206/219 |
| 4,258,845 | 3/1981 | Potts | 206/221 |
| 4,267,925 | 5/1981 | Crankshaw et al. | 206/221 |

FOREIGN PATENT DOCUMENTS

| | | |
|---|---|---|
| 1044686 | 11/1953 | France . |
| 2483365 | 12/1981 | France . |
| 90/07319 | 7/1990 | PCT Int'l Appl. . |

*Primary Examiner*—Jimmy G. Foster

[57] ABSTRACT

The container (10) comprises a first compartment (11) and a second compartment (12) which are separated by a central cylindrical throat (13). The compartment (11) is extended by a neck (14) which comprises a first region (15) adjacent to the upper open end of the container and a second region (16) located between the first region (15) and the inside of the container. The region (15) has one section which is greater than that of region (16). Both regions (15, 16) are substantially cylindrical. The section of the second region (16) is substantially identical to that of the central cylindrical throat (13). An intermediate sealing plug (17) compressed into the central cylindrical throat (13) allows sealed storage of two different substances in the compartments (11) and (12). A sealing member (23) inserted into region (15) of the neck (14) is displaceable between a first, storage position, in which it acts as a seal, and a second, ready for use position.

16 Claims, 12 Drawing Sheets

ELONGATE CONTAINER HAVING TWO SEPARATE COMPARTMENTS, ONE BEING AN EXTENSION OF THE OTHER

The present invention concerns an elongate container having two separate compartments, one being an extension of the other, the first of which contains a liquid and the second either a liquid, a powder or a lyophilisate, said substances to be mixed in the second compartment, said container comprising a central cylindrical throat in which there is an intermediary sealing plug for separating the two compartments when the container is being stored, as well as an open cylindrical neck of narrower section than those compartments, in which a movable sealing member is engaged comprising at least one active portion disposed to be displaceable between a first position called the storage position, in which it constitutes a sealing plug, and a second, ready for use position.

Containers with two compartments designed to respectively hold a liquid, a powder substance or a lyophilisate and a liquid solvent and which are separated during storage by a removable intermediate plug are already known, particularly in medical usage. Such a container is described, for example, in French Patent No. 1.044.686 which describes a tubular bottle with a V-shaped ring throat at the center in which an intermediate sealing plug is inserted for separating the two compartments. In some versions the bottle is open at both ends, which are stoppered with sealing plugs after filling the compartments, and in other versions the bottle is open only at one end. The bottle is essentially cylindrical along its entire length, except for the central annular ring holding the intermediate sealing plug.

This type of bottle has numerous disadvantages because of its construction. The annular ring has a slightly different interior diameter than that of the two cylindrical chambers disposed on one side and the other of the ring; this is to permit the intermediate sealing plug to be guided and positioned. But this construction is flawed. When the plug is pushed back to mix the components, if it tips obliquely, it may become blocked between the walls of the lower chamber, prevent the liquid from flowing and ultimately prevent mixing the components. This can happen because the bottle diameter is smaller than the diagonal measurement of the intermediate sealing plug.

The intermediate sealing plug is only held weakly in place by the rim. The seal between the two compartments is unreliable. Furthermore, inadvertent pressure exerted on the end plug causes displacement of the intermediate plug and risks accidental transfer of liquid from one compartment to the other.

It is also questionable how the end plug can be positioned without displacing the intermediate plug if the compartment between these two plugs is filled with liquid. Pressure necessarily exists in the bottle, thereby causing a twofold risk: that of making the bottle open and that of displacing the intermediate plug.

Finally, the embodiment illustrated in this patent does not guaranty an inviolable system. The end plugs are an ordinary type and may be opened and then replaced without the end user realizing it.

French Patent Application Publication No. 2 483 365 describes a vial for medicinal substances which, during storage, are in the form of two components isolated in two chambers separated by an intermediate sealing plug. Placement of the sealing plug is delicate because it cannot be pre-positioned in the vial neck. Moreover, the plug is essentially the same height as the narrow central throat where the plug is located, so that the latter must not undergo any axial displacement after positioning to avoid breaking the seal between the two chambers. As a result, the plug for the neck of the bottle must be positioned using special conditioning machines to allow evacuation of a volume of air substantially equivalent to the volume of the portion of the plug penetrating the neck, thereby eliminating pressure capable of axially displacing the intermediate sealing plug. Such machines are costly, cannot attain high speeds and require pressure control means.

To eliminate the use of such auxiliary equipment a substantial volume of gas is left above the liquid in the upper compartment, which makes the phase of pushing back the intermediate sealing plug difficult and risky.

The present invention proposes overcoming all these disadvantages and sets forth a number of interesting solutions for filling as well as use. The content of the invention responds totally to current requirements of the pharmaceutical industry and medical environments, which are:

the ability to completely mix products in a sealed environment without contaminating one chamber with the product stored in the other;

safety during use;

ease of use;

ease of manufacture at competitive prices.

To achieve this, the container according to the invention is characterized in that the neck has a first region adjacent the open extremity and a second region located between the said first region and the inside of the container, in that said second region has a transverse section smaller than that of the first region, in that the first region has a transverse section larger than that of said active portion of the movable sealing member, and in that the second region has one section which is at the most equal to that of said active portion.

According to a first preferred embodiment of the container, said active portion of the movable sealing member has one section larger than that of said second region so that this portion is compressed when engaged in said zone.

The movable sealing member preferably comprises at least one ring extending said active portion, said ring having a section larger than that of said first region of the neck.

In this embodiment the height of said active portion of the movable sealing member may be at least equal to the height of said first region.

Advantageously, the transverse section of the central cylindrical throat is essentially identical to that of said second region of the neck.

According to this particularly advantageous embodiment, the section of the intermediate sealing member is smaller than that of said first region of the neck and at least equal to that of said second region of the neck.

According to another embodiment, the section of the intermediate sealing plug may be larger than that of said second region of the neck.

The height of the intermediate sealing plug is advantageously greater than the height of the central throat.

Preferably, the movable sealing member comprises a rigid structure with a connecting tip and a flexible cap with an annular skirt having at least one lateral opening.

According to a second embodiment of a container with a circular axis of symmetry, the diameter of the second compartment is greater than the diagonal measurement of the intermediate sealing plug.

According to a third preferred embodiment, the container initially has only one opening at the end of its neck.

According to a fourth embodiment, the container initially has a second opening at one end opposite said neck, said opening being disposed to receive a closing plug after the second compartment has been filled.

In the first preferred embodiment the movable sealing member is associated with a rigid connecting tip comprising a central conduit, and communication means are provided for the solution obtained after mixing the components of said first compartment to pass through said central conduit.

Preferably, said communication means consists of a lateral passage disposed in said flexible skirt on the movable sealing member.

In this embodiment the movable sealing member may be integral with a capsule and said capsule may have a vent and a hydroponic filter to evacuate the pressurized gases inside the first compartment.

Advantageously, the movable intermediate sealing plug is initially situated in the central cylindrical throat in such a way that its height, X, inside the first compartment corresponds at the most to the volume of liquid held in this compartment and displaced when the movable sealing member is placed in the storage position in said second region of the neck.

This movable intermediate sealing plug may also be initially situated in the central cylindrical throat in such a way that its height, X, inside the first compartment corresponds to a smaller volume than that of the liquid held in this compartment and displaced when the movable sealing member is placed in the storage position in said second region of the neck.

In this type of container, after pre-positioning of the movable sealing member in the first region of the neck, the volume of liquid corresponding to height $L_2$, which represents the difference in level between the surface N of the liquid and the inside extremity of the neck, is greater than the volume of the portion of the intermediate sealing member which is located in said first compartment.

The present invention will be better understood with reference to the description of various exemplary embodiments and to the attached drawing, wherein.

Figure 1:
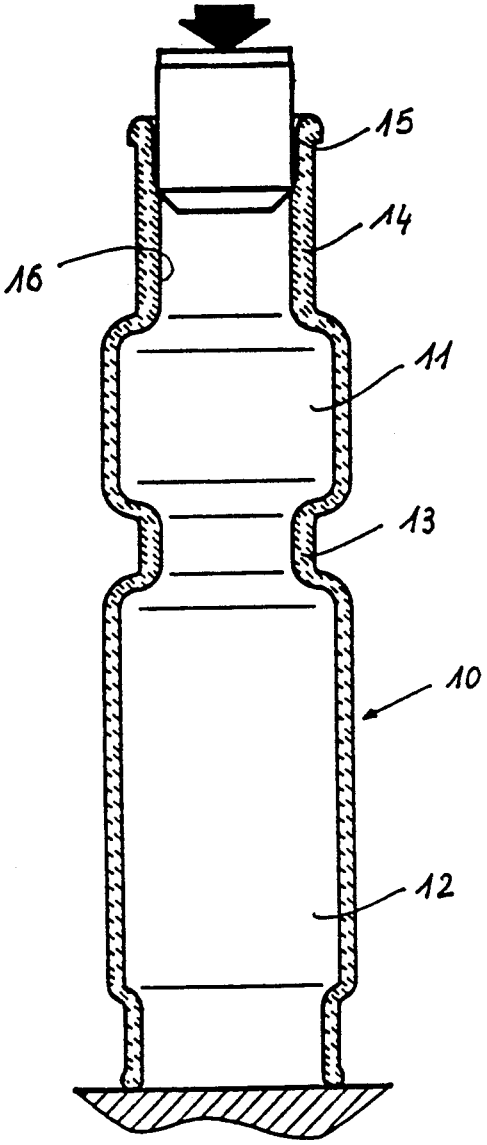
FIGS. 1 through 7 show the different phases in filling a container according to the invention which is open at both ends and designed to receive a liquid in one of the two compartments and a powder in the other compartment.

With reference to FIG. 1, container 10 comprises a first compartment 11 and a second compartment 12 which are separated by a central cylindrical throat 13. Compartment 11 is extended by a neck 14 which comprises a first region 15 adjacent the upper open extremity of the container and a second region 16 between the first region 15 and the inside of the container. Region 15 has one section which is larger than that of region 16. The two regions 15 and 16 are generally cylindrical. The section of the second region 16 is essentially equal to that of central cylindrical throat 13.

During the first phase of using the container, or more precisely of filling it, an intermediate sealing plug 17 is pre-positioned in said first region 15 of neck 14. The section of this intermediate sealing plug 17 is smaller than that of said first region 15 but equal to, or even slightly larger than, that of second region 16. This pre-positioning, which is made possible by the existence of said first region of enlarged section, is extremely important for various reasons which will become apparent in the remainder of this description. The first advantage of this is that makes placement of intermediate sealing plug 17 especially easy.

Figure 2:
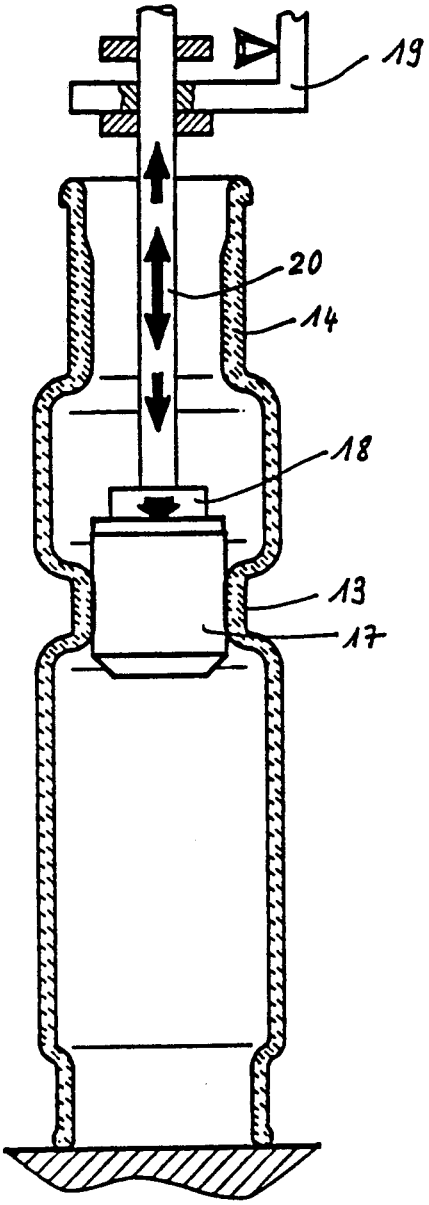

FIG. 2 shows the phase which consists of positioning the intermediate sealing plug 17 in the central cylindrical throat 13. This is done by means of a button 18 connected to a mechanism 19 (shown schematically) by means of a rod 20. This button forces the intermediate sealing plug through neck 14 to place it in the position shown in the drawing. Note that the height of the intermediate sealing plug is greater than that of the central cylindrical throat for reasons which will be explained hereinafter.

Figure 3:
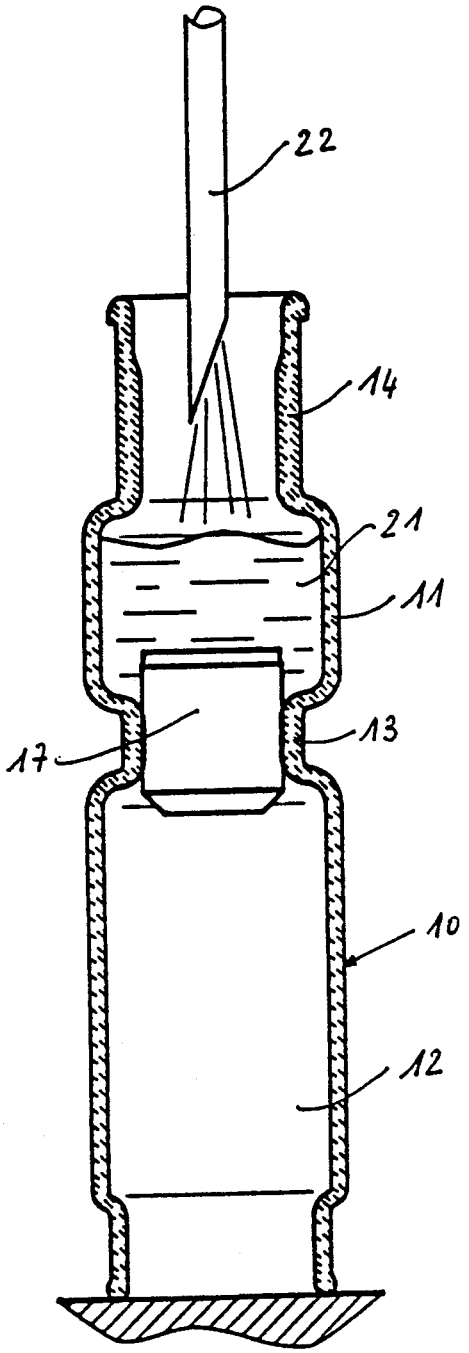

The next phase, which consists of filling compartment 11 with a liquid 21, generally a solvent, is shown in FIG. 3. The liquid is introduced by means of an injection tube 22 which penetrates neck 14 of container 10. The seal between the two compartments is effected by intermediate sealing plug 17 which is sufficiently compressed in the central cylindrical throat to guarantee impermeable sealing of compartment 12.

Figure 4:
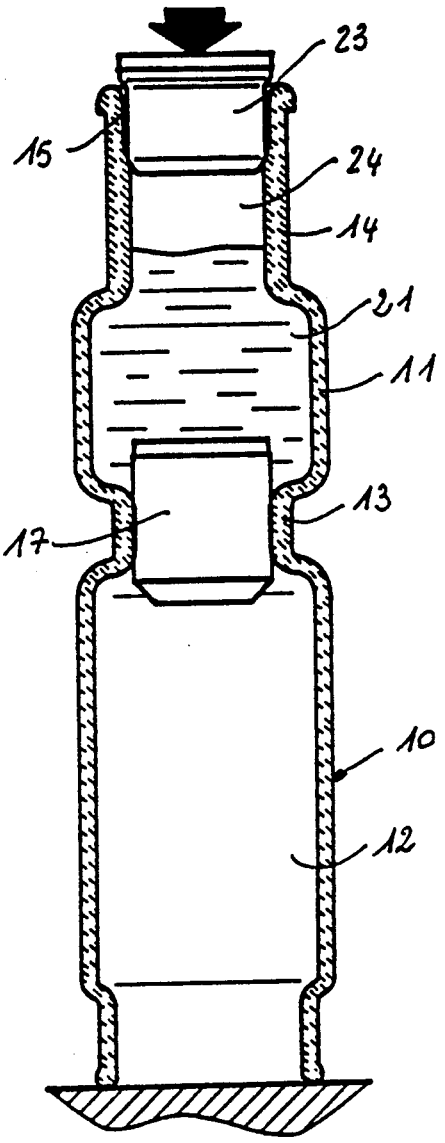

FIG. 4 shows the beginning of the phase of positioning a movable sealing member 23 in first region 15 of neck 14. Actually, this device is pre-positioned in said first region 15 which, as mentioned above, has a larger section than that of region 16 of said neck. Movable sealing member 23 has one section which is smaller than that of region 15 so that this pre-positioning allows the gas 24 above liquid 21 to escape and thus avoids inducing pressure inside compartment 11. This is particularly important because, during this phase of pre-positioning the movable sealing member 23, the intermediate sealing plug 17, which is not subject to any constraint, is not axially displaced in central cylindrical throat 13.

Figure 5:
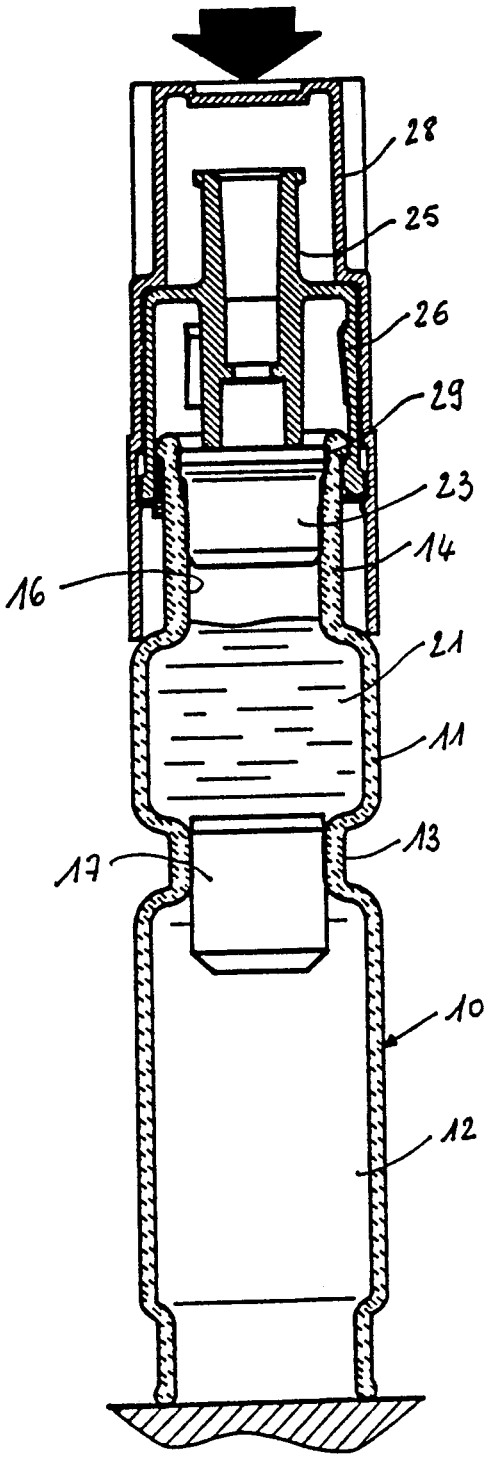

FIG. 5 shows a supplementary step in using the container, which consists of positioning the sealing member 23 as well as a connecting tip 25, the capsule shaped edge 26 of which engages above neck 14, specifically on ring 27 at the end of the neck. A protective cap 28 tops connecting tip 25 and covers this end of the container. Note that the movable sealing member 23 has been pushed into at least the second region 18 of the neck. Given the fact that the section of this movable sealing member, at least of its lower portion, is larger than the section of said second region 16, said sealing member is compressed and forms a tight seal in compartment 11. Displacement of this device engenders pressure inside compartment 11, which has the effect of axially displacing intermediate sealing plug 17. Given the fact that the height of this intermediate sealing plug is greater than that of the central cylindrical throat, this displacement does not in any way alter the tight seal between the two compartments 11 and 12.

For safety reasons and to prevent movable sealing member 23 from being thrust too deeply inside the neck, the latter has on its upper portion one or more rings 29 which function both as retainers and as antiseptic barriers and which, when the device is in use, serve as tight connections preventing accidental flow of solvent 21.

Figure 6:
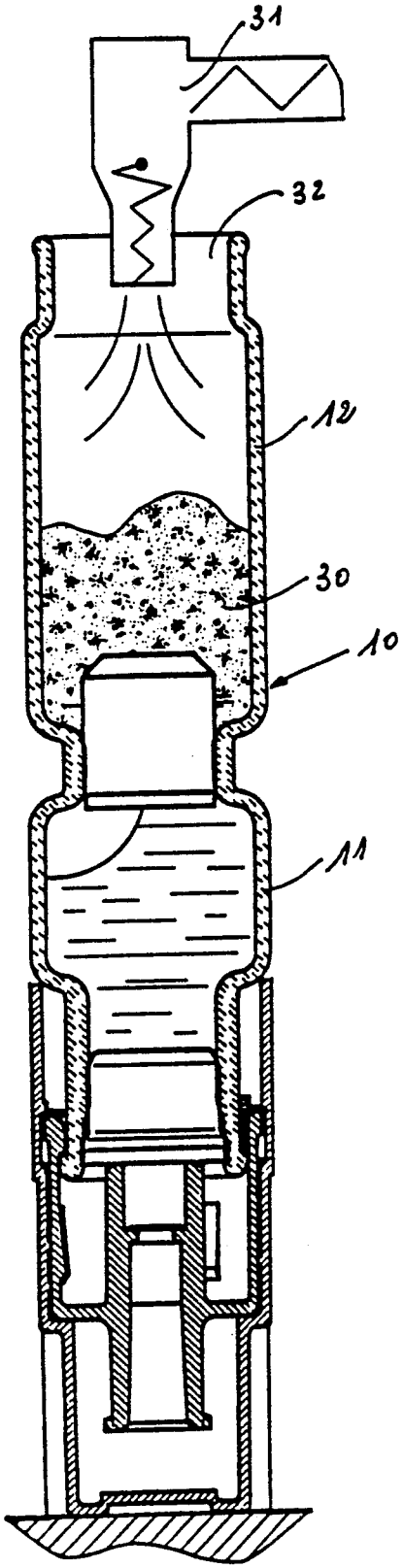

After turning over the container, compartment 11 of which is filled and tightly sealed, one proceeds to prefilling compartment 12 with a powder 30 which is introduced with an appropriate device 31 and which will be mixed with the solvent before using the mixture thus obtained. This phase is shown in FIG. 6. Device 31 engages in the lower opening 32 of container 10. Given the fact that compartment 11 is filled and tightly sealed at both ends, no contamination by powder 30 can occur.

Figure 7:
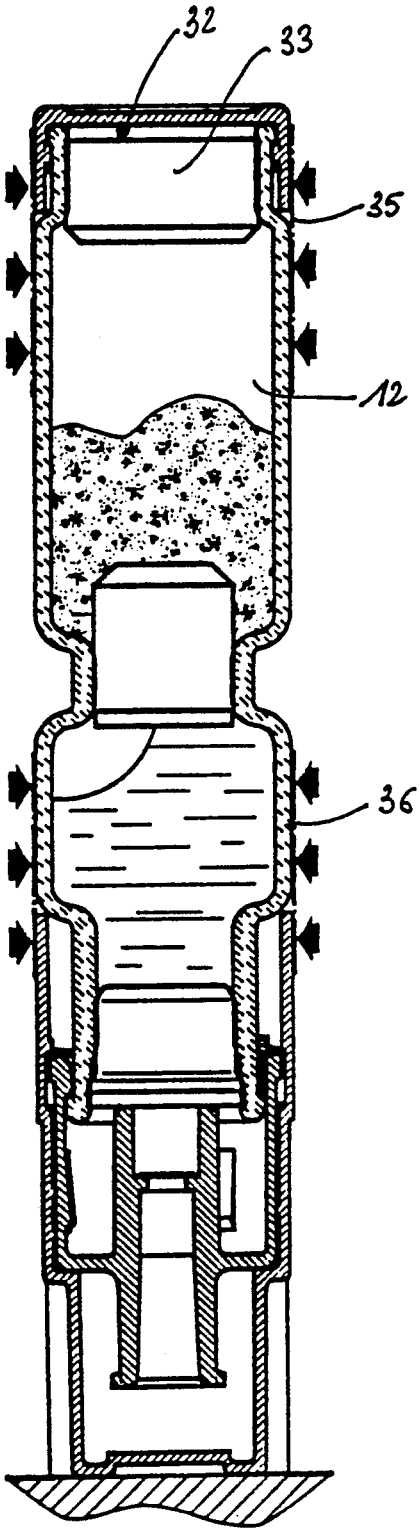

The next phase is shown in FIG. 7, which shows the container ready for use or ready for storage. A closing seal 33 has been positioned to seal extremity 32 of compartment 12. A capsule 34 has been set over said extremity 32 to ensure definitive closing of this end of the container. Two safety seals, 35 and 36 respectively, have been put in place to prevent tampering with the container.

Figure 8:
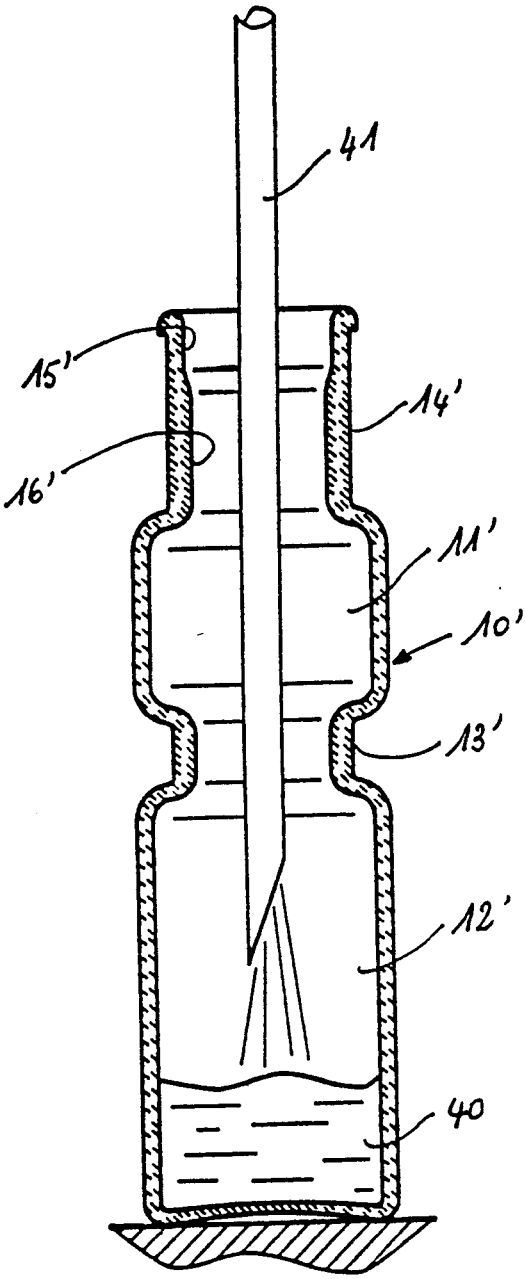
FIGS. 8 through 15 show the different phases in filling a container according to the invention which is closed at one end and designed to receive a lyophilisate in one of the two compartments and a solvent in the other compartment.
Figure 9:
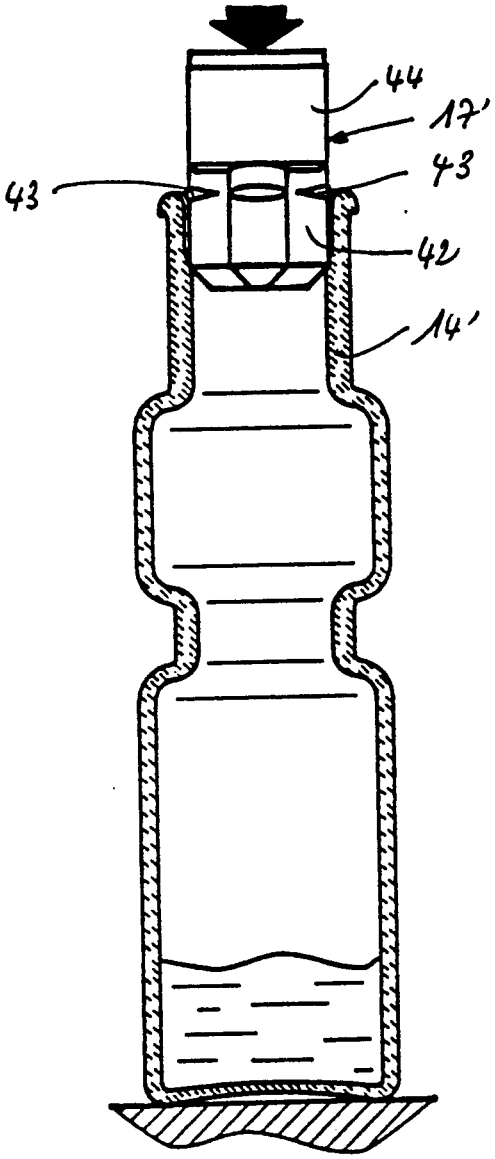

FIG. 8 shows the first phase of filling a container 10' which differs from container 10 in that it is closed at one end. As before, it comprises a first compartment 11' and a second compartment 12' separated by a central cylindrical throat 13'. Upper compartment 11' extends into a neck 14' which comprises, as before, a first region 15' and a second region 16' with the same characteristics as corresponding regions 15 and 16 in the previous drawings. The first phase consists of filling lower compartment 12' with a solution 40 which is poured through a tube 41 penetrating inside the container.

The next phase consists of pre-positioning an intermediate sealing plug 17' in first region 15' of neck 14'. This intermediate sealing plug 17' has a lower region 42 provided with notches or discharge means 43 whose role will be explained hereinafter, and an upper zone 44 which is essentially identical to intermediate sealing plug 17.

Figure 10:
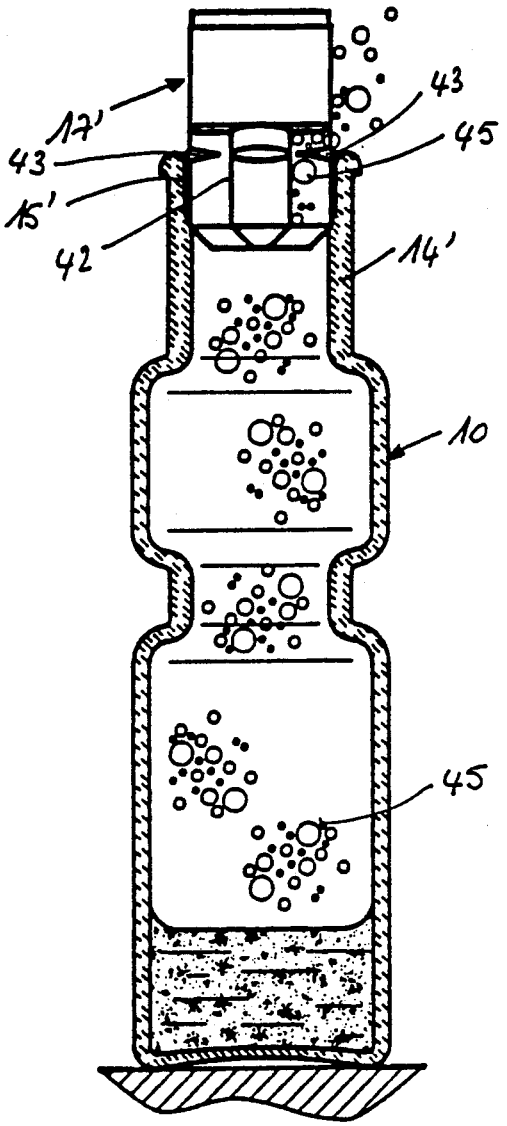

FIG. 10 shows the lyophilization phase, during which gases 45 can escape from container 10' despite the fact that intermediate sealing plug 17' is prepositioned in neck 14'. This is possible because the section of lower portion 42 of this intermediate sealing plug is smaller than the section of said first region 15' of neck 14', and because of the presence of discharge means 43.

Figure 11:
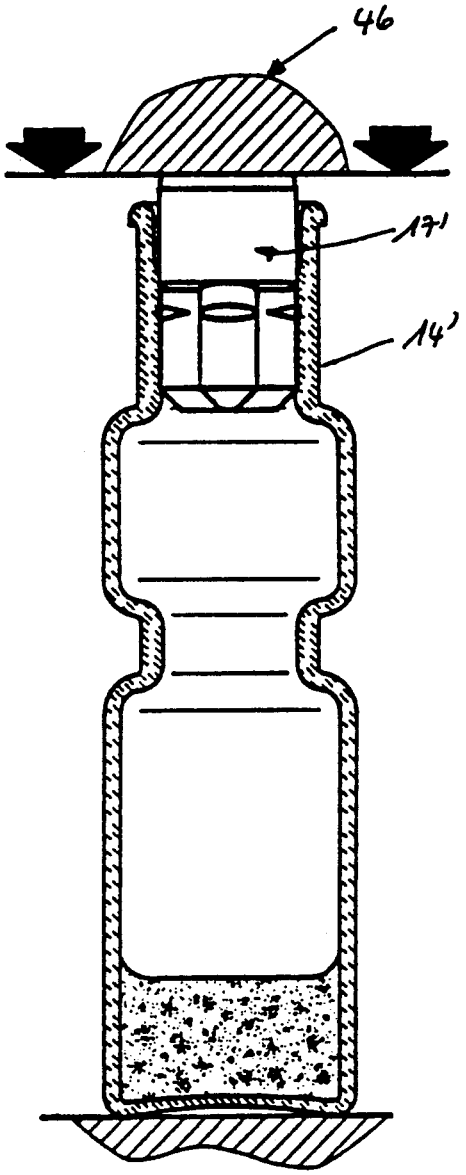

At the end of lyophilization, intermediate sealing plug 17' is inserted into neck 14' by means of a plate 46 (shown schematically) in the enclosed area with the lyophilizer and under inert gas. This phase is illustrated in FIG. 11.

Figure 12:
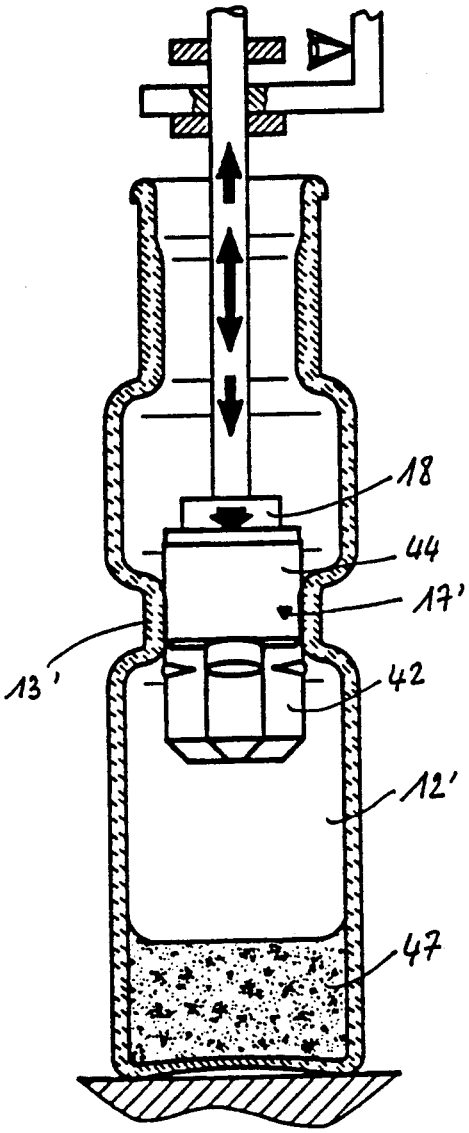

FIG. 12 shows the definitive positioning of intermediate plug 17' in central cylindrical throat 13' using a button 18 identical to that which was shown in FIG. 2. Intermediate sealing plug 17' is inserted into central cylindrical throat 13' far enough so that its upper portion 44 engages in this throat, the lower portion 42 being located beyond this throat inside lower chamber 12' containing the lyophilisate 47.

Figure 13:
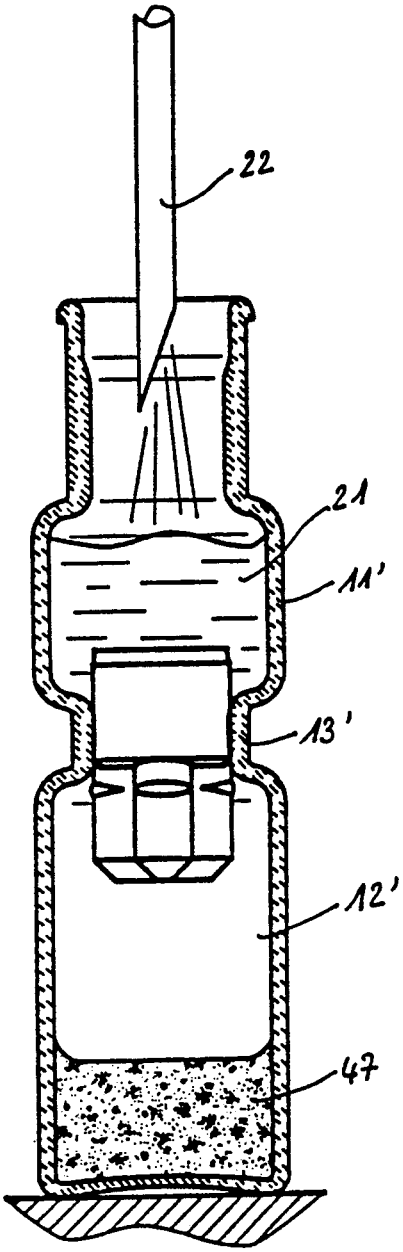

FIG. 13 shows the phase of filling compartment 11' with a liquid 21 which is principally a solvent to be mixed with the lyophilisate 47. Filling is done through an injection tube 22 identical to that shown in FIG. 3.

Figure 14:
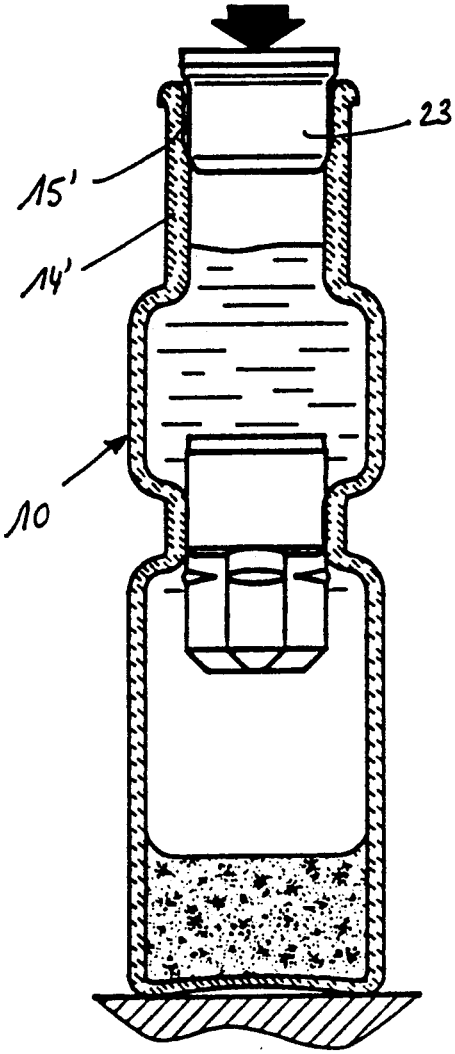
Figure 15:
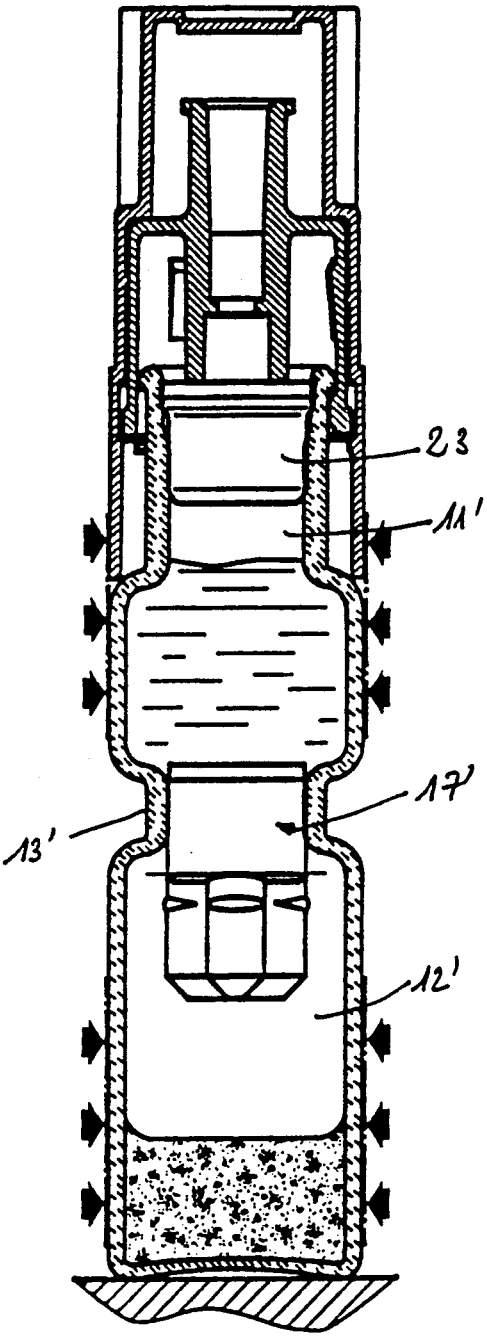

Container 10 is then closed by means of a movable sealing member 23 which is identical to that shown in FIG. 4. This sealing member is first pre-positioned in the first region 15' of enlarged section in neck 14', as shown in FIG. 14, then pushed inside as before during a phase shown in FIG. 15. This phase is in every respect identical to that which was described with reference to FIG. 5. Positioning the movable sealing member 23 causes pressure to increase inside chamber 11'. This pressure acts upon intermediate sealing plug 17' which is engaged farther forward in central cylindrical throat 13'. As before, its length is determined in such a way that it lodges to maintain a seal between the two compartments 11' and 12'.

Figure 16:
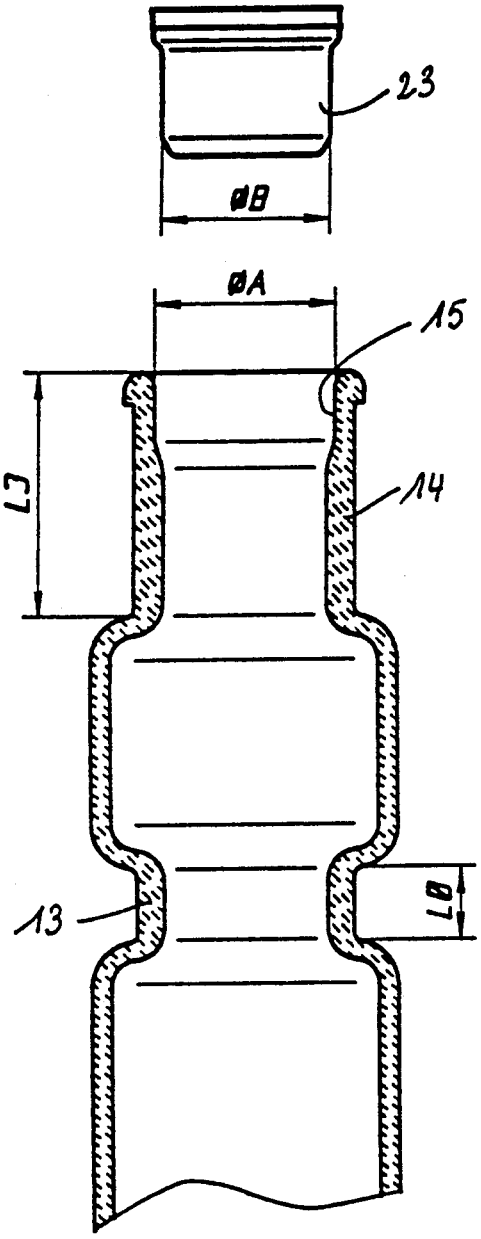
FIGS. 16 and 17 are detailed views showing the relationship of the dimensions between certain portions of the container and the sealing members.
Figure 17:
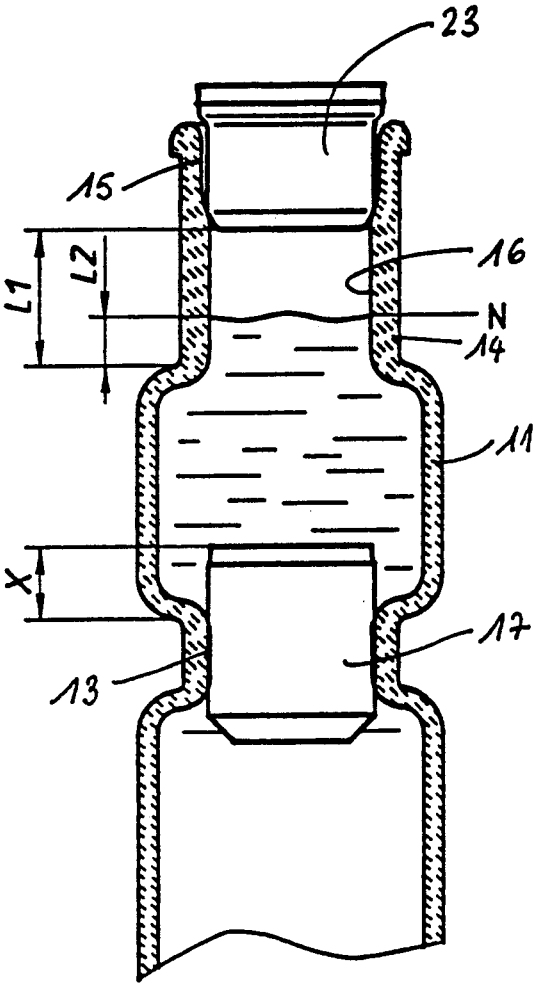

With reference to FIGS. 16 and 17, movable sealing member 23 has in its lower portion a diameter B which is smaller than diameter A of first region 15 of neck 14. $L_1$ is the height of the second narrowed region 16 of neck 14 and $L_2$ represents the distance which separates the level N of liquid in upper compartment 11 from the base of narrow region 16. X is the height of the portion of the intermediate sealing plug 17 which exceeds the height of central cylindrical throat 13 when movable sealing member 23 is pre-positioned in first region 15 without being inserted in second region 16. $L_3$ is the total height of neck 14 and $L_0$ is the total height of central cylindrical throat 13. At the time of filling, the volume of liquid introduced into compartment 11 is calculated so that before closing this compartment, the intermediate sealing plug surpasses the height of the central cylindrical throat having the value X. The movable seal 23 must be positioned in such a way that $L_2$ is superior or equal to X. The volume of gas surmounting the level N of liquid may be minimal and could theoretically be nul, since it plays no role in the hydraulic functioning of the system once the container is activated. In other words, $L_2$ could increase to attain the value $L_1$. In practice, a certain quantity of gas is allowed to remain to absorb tolerances in the glass and to fill compartment 11 without causing the solvent to overflow. The volume of liquid corresponding to height $L_2$ is greater than that corresponding to the value X.

Figure 18:
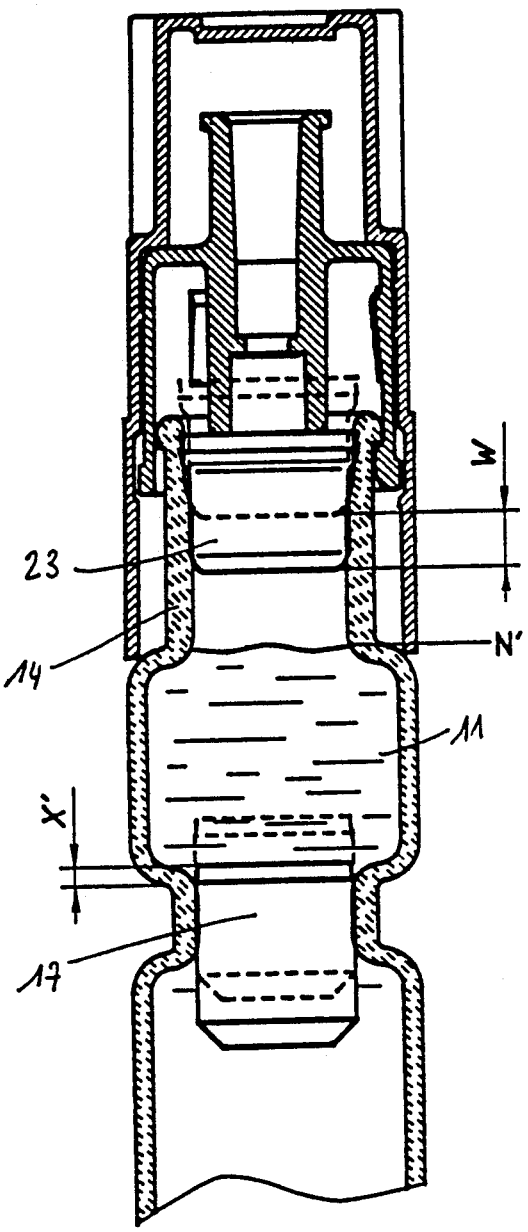
FIGS. 18 and 19 show the phases of activating the container according to the invention.

FIG. 18 shows the phase of closing the container, that is, the positioning of movable sealing member 23 in neck 14. At the time of closing, movable sealing member 23 is displaced by a value W and engenders an equivalent displacement of intermediate sealing plug 17, assuming the sections of these two components are identical. In the case of the sections being different, the volume displaced by movable sealing member 23 is equivalent to that displaced by intermediate sealing plug 17. Theoretically, W can be equal to X. If losses due to the intermediate sealing plug rubbing against the walls of the central throat are discounted, this plug is displaced on a course equivalent to W or a course corresponding to a displaced volume W. Level N is brought to level N'. Given the fact that the volume equivalent to $L_2$ is greater than or equal to the volume corresponding to X or W, the new level N' of liquid in compartment 11 does not surpass neck 14. In practice, for safety reasons and because of the presence of a gas surmounting level N' and the existence of rubbing forces from the intermediate sealing plug on the walls of the cylindrical central throat, there will subsist a residual value X' which corresponds to a certain displacement of intermediate sealing plug 17 in compartment 11.

Figure 19:
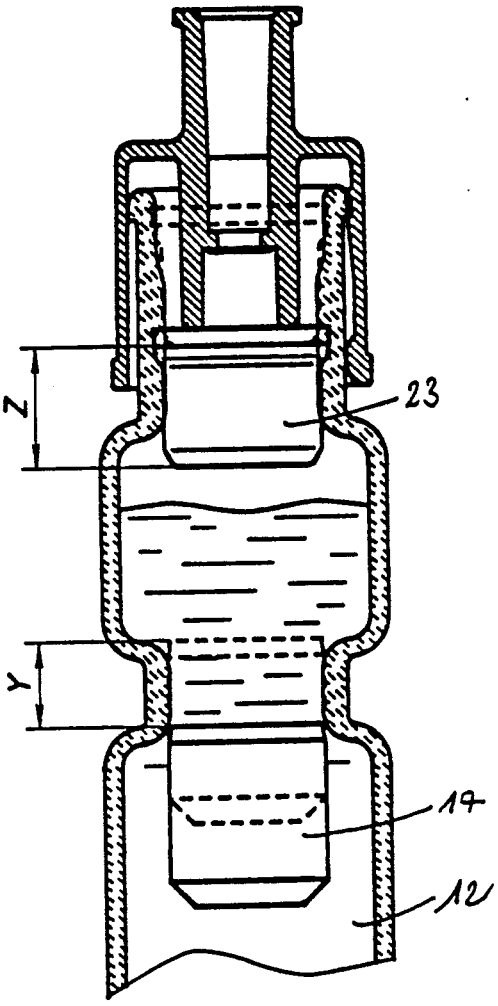

Activation of the container is shown in FIG. 19. Y represents the height of the central cylindrical throat increased by the residual value X' of the displacement of intermediate sealing plug 17 in upper compartment 17. Z represents the course of activation of movable sealing member 23. In order for intermediate sealing plug 17 to fall into compartment 12, course Z must be greater than course Y. For safety reasons, level N' defined previously must be situated in the region corresponding to course Z of the movable sealing member, thereby guaranteeing the hydraulic functioning of the system, that is, establishing communication between the two compartments.

Figure 20:
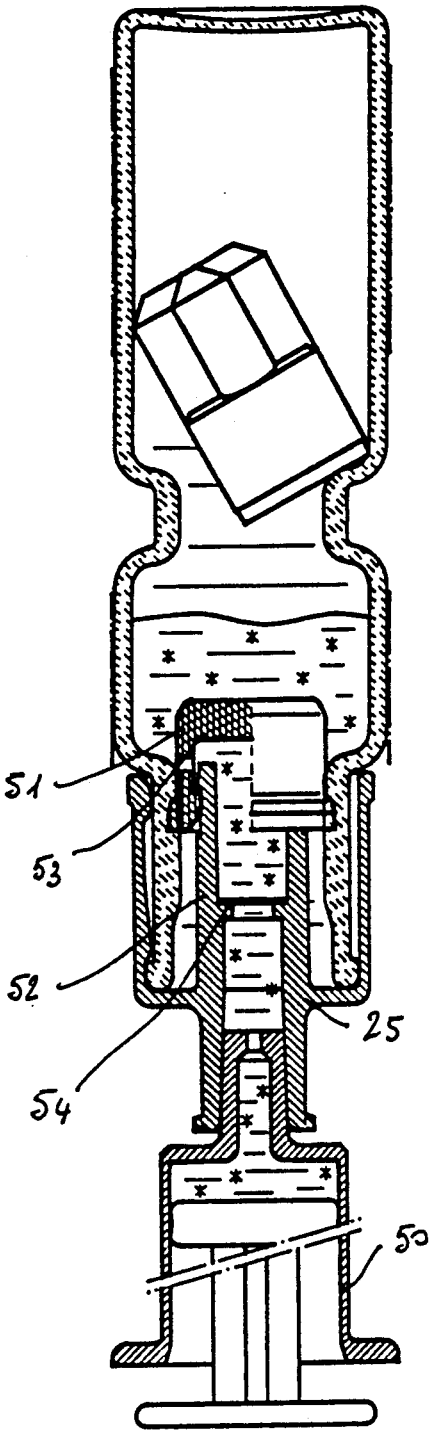
FIGS. 20 and 21 show some specific uses of the container according to the invention.
Figure 21:
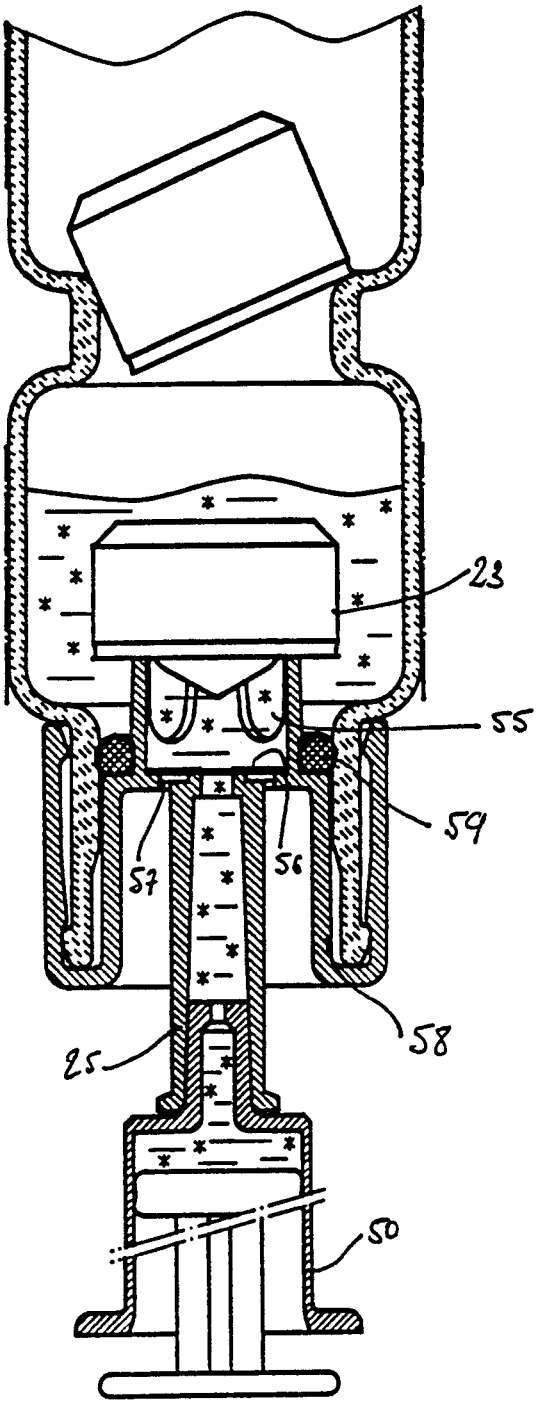

In the exemplary uses shown in FIGS. 20 and 21, container 10 is sealed at the neck level by a movable sealing member integral with a connecting tip 25 to which an injection syringe 50 is connected. In the case of FIG. 20, movable sealing member 23 consists of a flexible skirt 51 attached to a cylindrical extension 52 of connecting tip 25. Flexible skirt 51 has a lateral opening 53 allowing the injectable medicinal solution, which has been obtained by mixing the two components initially contained in the two compartments 11' and 12', to flow through the central conduit of the tubular extension of the connecting tip, then through the central conduit of said tip to syringe 50. The two central conduits referred to above are preferably separated by a filter 54 to retain any solid particles which may remain in the mixture.

In the case of FIG. 21, the movable sealing member 23 has no lateral opening. So that the mixture may flow, this movable sealing member is attached to a support integral with connecting tip 25, which has lateral openings 55. A hydroponic filter 56 may also be interposed on the evacuation course of the mixture, and a vent 57 for evacuation of gases is disposed in the capsule holding connecting tip 25. Certain substances have the peculiar quality of generating considerable quantities of anhydrous carbon at the time the two components are mixed. This is the case with fourth generation cephalosporines, for example, of which 1 g of powder when mixed with 4 to 5 ml of water can produce up to 50 ml of $CO_2$. In the absence of said hydroponic filter and the corresponding vent, the piston of syringe 50 would be ejected due to the effect of gas pressure. In this case, the movable sealing member 23 must be completely pushed back inside the first compartment. Sealing the neck is achieved by a toric connection 59.

Figure 22:
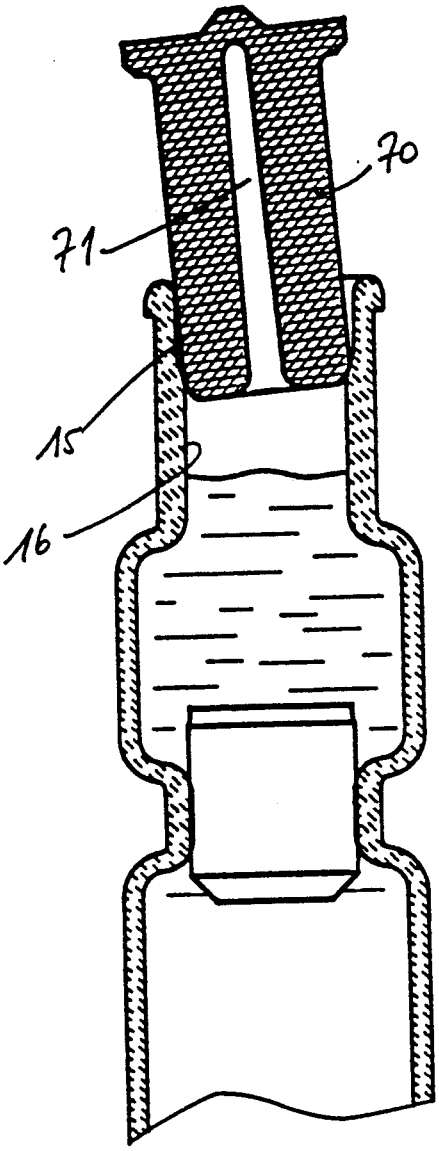
FIGS. 22 and 23 show some particularly advantageous embodiments of the container according to the invention.
Figure 23:
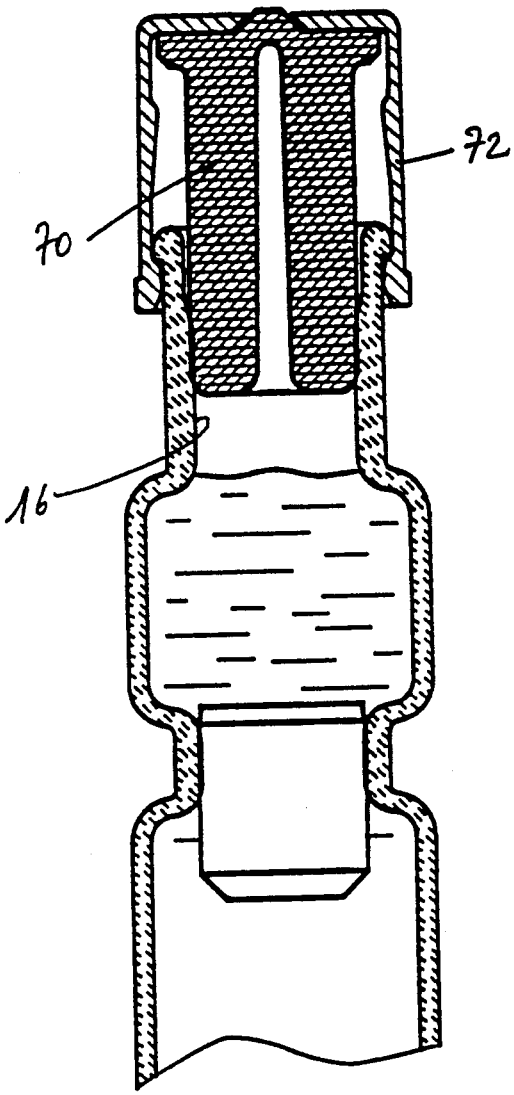

The embodiment shown in FIGS. 22 and 23 comprises a movable sealing member 70 consisting of an elastomeric plug which is flexible because it has a central cavity 71. As in the examples previously illustrated, this plug may be pre-positioned in the first region 15 of enlarged section in neck 14, before being tightly positioned in the second zone 16 of narrow section and set with the safety cap 72.

The container shown offers numerous advantages over the prior art. In particular, the embodiment which is open at both ends allows final sterilization after filling by autoclaving the solvent at 120°. This allows bactericide preservative agents to be omitted from the solvent.

I claim:

1. An elongated container comprising first and second separate compartments for containing two separate substances to be mixed together, one compartment being an extension of the other, the first compartment being suitable for containing a liquid substance, and the second compartment being suitable for containing one of a liquid substance, a powder substance and a lyophilisate substance, and the two separate substances being mixable in the second compartment a central cylindrical throat having an intermediate sealing plug for separating the first and second compartments while the container is being stored;

said container including at least one open end being formed in at least one cylindrical neck integral with at least one of said first and second compartments, said at least one cylindrical neck' having a narrower cross-section than a cross-section of said at least one of said first and second compartments integral with said at least one cylindrical neck, and a movable sealing plug engaging said at least one cylindrical neck, said movable sealing plug comprising at least one active sealing portion, said movable sealing plug being displaceable between a first storage position and a second, ready for use, position, and said movable sealing plug facilitating mixing of the two separate substances to be mixed together;

wherein said at least one cylindrical neck has a first region adjacent the open end of said cylindrical neck, and a second region situated between said first region and said at least one of said first and second compartments integral with said at least one cylindrical neck, said second region has a transverse cross-section which is smaller than that of the first region, the first region has a transverse cross-section which is larger than the transverse cross-section of said active portion of the movable sealing plug, the second region of said at least one cylindrical neck has at least one section which has a smaller cross-section than the cross-section of said active portion of said movable sealing plug, and the cross-section of the intermediate sealing plug is smaller than the cross-section of said first region of the cylindrical neck and is larger than the cross-section of said second region of the cylindrical neck.

2. Container according to claim 1, wherein the movable sealing member comprises at least one ring (29) extending said active portion, said ring having a section larger than that of said first region (15, 15') of the neck (14, 14').

3. Container according to claim 2, wherein the height of said active portion of the movable sealing member is at least or long as the height of said first region (15, 15') of the neck (14, 14').

4. Container according to claim 1, wherein the transverse cross-section of the central cylindrical throat is essentially identical to the transverse cross-section of said second region of the neck.

5. Container according to claim 4, wherein the intermediate sealing plug (17) is movable between at least a first and a second position, in said first position, said intermediate sealing plug is disposed in the central cylindrical throat (13, 13') in such a way that a height X of the intermediate sealing plug which extends inside the first compartment (11, 11') corresponds at the most to a liquid substance displacement distance corresponding to a volume of liquid substance held in the first compartment and which is displaced when the movable sealing member (23) is placed in the storage position in said second region (16, 16') of the neck (14, 14').

6. Container according to claim 4, wherein the intermediate sealing plug (17) is movable between at least a first and a second position, in said first position, said intermediate sealing plug is disposed in the central cylindrical throat (13, 13') in such a way that a height X of the intermediate sealing plug which extends inside the first compartment (11, 11') corresponds to less than a liquid substance displacement distance corresponding to a volume of liquid substance held in the first compartment and which is displaced when the movable sealing member (23) is placed in the storage position in said second region (16, 16') of the neck (14, 14').

7. Container according to claim 4, wherein when the movable sealing member (23) is disposed in the first zone (15, 15') of the neck (14, 14'), a volume of liquid substance corresponding to height L2, which represents the difference in level between the surface N of the liquid substance and the inside extremity of the neck, is greater than the volume of the portion of the intermediate sealing plug (17) corresponding to a height X which extends in said first compartment (11, 11').

8. Container according to claim 1, wherein the height of the intermediate sealing plug (17, 17') is greater than the height of the central throat (13, 13').

9. Container according to claim 1 having a circular axis of symmetry, wherein the diameter of the second compartment (12, 12') is larger than the diagonal measurement of the intermediate sealing plug (17, 17').

10. Container according to claim 1, wherein initially the container has only one opening at the extremity of the neck (14).

11. An elongated container in which is to be formed two separate compartments containing two separate substances to be mixed together, one compartment being an extension of the other, wherein a first compartment contains a liquid substance, and a second compartment contains one of a liquid substance, a powder substance and a lyophilisate substance, wherein said two separate substances to be mixed being mixed in the second compartment, said container comprising:

a central cylindrical throat in which there is an intermediate sealing plug for separating the first and second compartments while the container is being stored, wherein the cross-section of the intermediate sealing plug is smaller than that of said first region of the at least one cylindrical neck, and larger than the cross section of said second region of the at least one cylindrical neck; said container including at least one open end formed in at least one cylindrical neck integral with at least one of said first and second compartments, said at least one cylindrical neck having a narrower cross-section than a cross-section of said at least one of said first and second compartments integral with said cylindrical neck, and in which a movable sealing member engages, said movable sealing member comprising at least one active sealing portion, said movable sealing member displaceable between a first storage position, wherein said movable sealing member constitutes a sealing plug, and a second, ready for use position wherein said movable sealing member facilitates mixing of said two separate substances to be mixed together; and wherein said at least one cylindrical neck has a first region adjacent the open end of said cylindrical neck, and a second region situated between said first region and said at least one of said first and second compartments integral with said cylindrical neck, wherein said second region has a transverse cross-section which is smaller than that of the first region, wherein the first region has a transverse cross-section which is larger than the transverse cross-section of said active portion of the movable sealing member, and further, wherein the second region of said at least one cylindrical neck has at least one section which has a smaller cross-section than the cross-section of said active portion of said movable sealing member.

12. An elongated container comprising first and second separate compartments for containing two separate substances to be mixed together, one compartment being an extension of the other, the first compartment being suitable for containing a liquid substance, and the second compartment being suitable for containing one of a liquid substance, a powder substance and a lyophilisate substance, and said two separate substances, when contained in the first and second compartments, being mixable in the second compartment;

a central cylindrical throat having an intermediate sealing plug for separating the first and second compartments while the container is being stored;

said container including at least one open end being formed in at least one cylindrical neck integral with at least one of said first and second compartments, said at least one cylindrical neck having a narrower cross-section than a cross-section of said at least one of said first and second compartments integral with said at least one cylindrical neck, a movable sealing plug engaging said at least one cylindrical neck, said movable sealing plug comprising at least one active sealing portion, said movable sealing plug being displaceable between a first storage position and a second, ready for use, position in which said movable sealing plug facilitates mixing of said two separate substances to be mixed together;

wherein said at least one cylindrical neck has a first region adjacent the open end of said cylindrical neck, a second region situated between said first region and said at least one of said first and second compartments integral with said at least one cylindrical neck, said second region has a transverse cross-section which is smaller than that of the first region, the first region has a transverse cross-section which is larger than the transverse cross-section of said active portion of the movable sealing plug, the second region of said at least one cylindrical neck has at least one section which has a smaller cross-section than the cross-section of said active portion of said movable sealing plug, and the movable sealing plug comprises a rigid structure with a connecting tip and a flexible cap with an annular skirt having at least one lateral opening therein.

13. An elongated container comprising first and second separate compartments for containing two separate substances to be mixed together, one compartment being an extension of the other, the first compartment being suitable for containing a liquid substance, and the second compartment being suitable for containing one of a liquid substance, a powder substance and a lyophilisate substance, and said two separate substances, when contained in the first and second compartments, being mixable in the second compartment;

a central cylindrical throat having an intermediate sealing plug for separating the first and second compartments while the container is being stored;

said container including at least one open end being formed in at least one cylindrical neck integral with at least one of said first and second compartments, said at least one cylindrical neck having a narrower cross-section than a cross-section of said at least one of said first and second compartments integral with said at least one cylindrical neck, a movable sealing plug engaging said at least one cylindrical neck, said movable sealing plug comprising at least one active sealing portion, said movable sealing plug being displaceable between a first storage position and a second, ready for use, position in which said movable sealing plug facilitates mixing of said two separate substances to be mixed together;

wherein said at least one cylindrical neck has a first region adjacent the open end of said cylindrical neck, a second region situated between said first region and said at least one of said first and second compartments integral with said at least one cylindrical neck, said second region has a transverse cross-section which is smaller than that of the first region, the first region has a transverse cross-section which is larger than the transverse cross-section of said active portion of the movable sealing plug, the second region of said at least one cylindrical neck has at least one section which has a smaller cross-section than the cross-section of said active portion of said movable sealing plug, the container has a second opening at an end of said container opposite said at least one cylindrical neck, and said second opening receives a closing seal after one of the first and the second compartments is filled.

14. An elongated container comprising first and second separate compartments for containing two separate substances to be mixed together, one compartment being an extension of the other, the first compartment being suitable for containing a liquid substance, and the second compartment being suitable for containing one of a liquid substance, a powder substance and a lyophilisate substance, and said two separate substances, when contained in the first and second compartments, being mixable in the second compartment;

a central cylindrical throat having an intermediate sealing plug for separating the first and second compartments while the container is being stored;

said container including at least one open end being formed in at least one cylindrical neck integral with at least one of said first and second compartments, said at least one cylindrical neck having a narrower cross-section than a cross-section of said at least one of said first and second compartments integral with said at least one cylindrical neck, a movable sealing plug engaging said at least one cylindrical neck, said movable sealing plug comprising at least one active sealing portion, said movable sealing plug being displaceable between a first storage position and a second, ready for use, position in which said movable sealing plug facilitates mixing of said two separate substances to be mixed together;

wherein said at least one cylindrical neck has a first region adjacent the open end of said cylindrical neck, a second region situated between said first region and said at least one of said first and second compartments integral with said at least one cylindrical neck, said second region has a transverse cross-section which is smaller than that of the first region, the first region has a transverse cross-section which is larger than the transverse cross-section of said active portion of the movable sealing plug, the second region of said at least one cylindrical neck has at least one section which has a smaller cross-section than the cross-section of said active portion of said movable sealing plug, said movable sealing plug is associated with a rigid connecting tip comprising a central conduit, and communication means is provided to allow the solution obtained after mixing the two components in said second compartment to flow into said central conduit.

15. Container according to claim 14, characterized in that said communication means comprises a lateral passage (53) disposed in said flexible skirt (51) in the movable sealing member (23).

16. An elongated container comprising first and second separate compartments for containing two separate substances to be mixed together, one compartment being an extension of the other, the first compartment being suitable for containing a liquid substance, and the second compartment being suitable for containing one of a liquid substance, a powder substance and a lyophilisate substance, and said two separate substances, when contained in the first and second compartments, being mixable in the second compartment;

a central cylindrical throat having an intermediate sealing plug for separating the first and second compartments while the container is being stored;

said container including at least one open end being formed in at least one cylindrical neck integral with at least one of said first and second compartments, said at least one cylindrical neck having a narrower cross-section than a cross-section of said at least one of said first and second compartments integral with said at least one cylindrical neck, a movable sealing plug engaging said at least one cylindrical neck, said movable sealing plug comprising at least one active sealing portion, said movable sealing plug being displaceable between a first storage position and a second, ready for use, position in which said movable sealing plug facilitates mixing of said two separate substances to be mixed together;

wherein said at least one cylindrical neck has a first region adjacent the open end of said cylindrical neck, a second region situated between said first region and said at least one of said first and second compartments integral with said at least one cylindrical neck, said second region has a transverse cross-section which is smaller than that of the first region, the first region has a transverse cross-section which is larger than the transverse cross-section of said active portion of the movable sealing plug, the second region of said at least one cylindrical neck has at least one section which has a smaller cross-section than the cross-section of said active portion of said movable sealing plug, the movable sealing plug is integral with a capsule, and said capsule has a vent and a hydroponic filter for evacuating pressurized gas from the first compartment.

* * * * *